US005520615A

United States Patent [19]

Fontana et al.

[11] Patent Number: 5,520,615

[45] Date of Patent: May 28, 1996

[54] SHOULDER STRETCHING AND ROTATION MACHINE

[76] Inventors: Michelle Fontana; Anthony Fontana, both of 8 Pilgrim Ct., West Trenton, N.J. 08628; Leon N. Costa, 40 Pheasant Run Dr., Skillman, N.J. 08558

[21] Appl. No.: 212,058

[22] Filed: Mar. 14, 1994

[51] Int. Cl.[6] ..... A61H 1/02

[52] U.S. Cl. ..... 601/33; 601/5; 482/131; 482/907

[58] Field of Search ..... 482/131, 133, 482/137, 139, 905, 907, 44, 904; 601/33, 34, 40, 5, 89, 97; 602/35, 36; 128/878; 273/188 R

[56] References Cited

U.S. PATENT DOCUMENTS

| | | | |
|---|---|---|---|
| 2,223,309 | 11/1940 | Swanson | 482/123 |
| 3,559,487 | 2/1971 | Parlato | 482/905 |
| 3,892,230 | 7/1975 | Baker et al. | 601/33 |
| 4,089,520 | 5/1978 | Ozbey et al. | 482/139 |
| 4,108,429 | 8/1978 | Minichiello | 482/139 |
| 4,844,448 | 7/1989 | Niznik | 482/904 |
| 4,846,468 | 7/1989 | McCoy, Sr. et al. | 482/905 |
| 5,076,579 | 12/1991 | Rickey | 482/142 |
| 5,391,132 | 2/1995 | Greenwald | 482/114 |

FOREIGN PATENT DOCUMENTS

| | | | |
|---|---|---|---|
| 11782 | of 1902 | Australia | 601/33 |
| 578447 | 6/1959 | Canada | 482/133 |
| 501833 | 4/1920 | France | 601/33 |
| 604849 | 5/1926 | France | 601/33 |
| 93416 | 3/1969 | France | 601/33 |
| 2541574 | 8/1984 | France | 602/32 |
| 1047475 | 10/1983 | U.S.S.R. | 601/33 |
| 1655496 | 6/1991 | U.S.S.R. | 601/33 |

*Primary Examiner*—Richard J. Apley
*Assistant Examiner*—Jeanne M. Clark
*Attorney, Agent, or Firm*—Brian L. Wamsley

[57] ABSTRACT

A self-assistive shoulder stretching and rotation machine for physical therapy of the shoulder wherein a supine person's forearm is secured to a forearm support that is attached to a horizontal support such that the forearm support may be moved in a 90° arc from vertical in either the left or right direction by the supine person's pulling on a rope. One end of the rope is attached to each side of the forearm support such that a continuous loop is formed. The loop is supported on one side by passing it through pulleys or eyelets attached to a vertical support at one end of the horizontal support. The patient lies in a supine position securing one forearm to the forearm support. When the patient pulls near one end of the rope, the forearm support may be moved in as much as 90° or more to one direction. When the person pulls on the opposite end of the rope, the forearm support is moved back through the vertical position, 90° or more in the opposite direction.

15 Claims, 3 Drawing Sheets

SHOULDER STRETCHING AND ROTATION MACHINE

This invention relates to rehabilitative machines for therapeutically exercising the shoulder following surgery or traumatic injury, or to aid in the recovery from shoulder joint disease. More particularly, this invention relates to an exercise machine which stretches the shoulder while providing either internal or external rotation of the shoulder joint through movement of the arm, the forearm of which is secured to a movable support. The rotation of the shoulder is self-assistive in that a person may manually operate the machine without assistance of a doctor or physical therapist, and while also controlling the degree of the stretch or rotation, the duration of the stretch or rotation, and the amount of force applied to stretch and rotate the shoulder rotation. The invention may also be portable and is more affordable than conventional shoulder stretching and rotation machines, allowing a patient to use the invention at home for rehabilitative and therapeutic exercise following release from a doctor's or hospital's care.

BACKGROUND OF THE INVENTION

With the advent of greater emphasis on physical fitness and exercise and with more and more participation by older individuals in sports, there has been a dramatic rise in traumatic injuries to the shoulder. Such injury and subsequent surgery often results in a decrease in the range of shoulder motion, including shoulder rotation. Decrease in range of shoulder motion can also be caused by progressive diseases such as tendinitis, bursitis, arthritis and adhesive capsulitis, commonly known as "frozen shoulder."

Also, within the last 15 years, advances in shoulder surgery have resulted in shorter convalescent periods and hospital stays. Shoulder surgery on an outpatient basis, such as arthroscopic surgery, is commonly practiced. Accordingly, there is now an increased need for outpatient physical therapy. It is also desirable for the patient to engage in exercise therapy in the home to increase the frequency of exercise resulting in faster shoulder rehabilitation while at the same time reducing medical costs.

It has been determined in recent years that after shoulder surgery regular physical therapy enhances recovery and shortens the time for recovery, especially for surgery involving shoulder repair, such as the repair of rotator cuff tears and decompression. It has been found that after an initial period of healing, regular stretching of the muscles by rotation of the shoulder increases both the flexibility and range of motion for the shoulder.

To avoid overtaxing and injury to the shoulder muscles after surgery gradual assistive, passive exercises such as shoulder rotation and stretching are recommended to be used rather than active exercise. In a passive exercise, the shoulder is stretched and rotated in a manner not requiring any force or exertion by the shoulder muscles themselves or through use of the arm. In active exercise, the shoulder muscles of the shoulder being exercised supply the force needed to cause the stretch or rotation.

In performing shoulder stretching and rotation exercises it has been found to be difficult for either the exerciser or an assistant to apply a steady, safe load to the shoulder. Moreover, it is difficult to accurately apply the same directional force for both internal rotation and external rotation of the shoulder each time the shoulder-related muscles are to be stretched. Thus, the extent to which the shoulder-related muscles are stretched can vary considerably from day to day and from time to time using exercise without an assisting apparatus.

It is known that after a muscle is stretched to or near its maximum level for a period of time, if maximum contraction of the muscle is made and the muscle has been allowed to relax, a proprioceptive neuromuscular facilitation phenomenon occurs whereby a dip in the muscle stretch reflex occurs so that the muscle can be stretched somewhat further. Thus, by increasing the range of stretching and rotation of the shoulder eventually to its full range of motion, the range of shoulder motion upon rehabilitation can be increased.

In the therapeutic and rehabilitative stretching and rotation of the shoulder described herein, it is desirable that the forearm remain in a fixed 90° angle with reference to the humerus of the upper arm, with the upper arm alongside or parallel to the body. The forearm may then be moved in a 90° arc to the left or the right, which cumulatively provides for a 180° stretch and rotation of the shoulder. This movement may occur while the patient is standing, but it is preferable for the patient to be lying on his or her back in a supine position. In addition, it is desirable that stretching and rotation of the shoulder be done in a passive state, i.e., without any tension or force on the shoulder other than the force required to move the forearm. The supine position removes the weight of the arm from the shoulder.

Prior to this invention, there were no devices known in physical therapy that could provide passive motion for both internal and external rotation and that were self-assistively operated. However, continuous passive movement machines for stretching and rotating the shoulder through flexion and extension of the arm are known in the art. Examples of such machines are the Cyvex Isokinetic Machine, the Biodex Isokinetic Machine, the Kincon Isokinetic Machine and the Continuous Passive Movement Machine (collectively referred to as "CPMs"). CPMs generally operate using motors, and thus do not provide for a release of force should stiffness or muscle soreness result in discomfort or pain after a certain degree of motion or stretch is reached. Further, CPMs are known only to provide for flexion and extension of the arm and shoulder and not internal and external rotation and stretching, particularly in the preferred supine position. Although CPMs are designed for the patient to be either in a vertical or supine position, both types generally drag the arm up and down. Because of the high costs involved, CPMs have to be used in conjunction with professional care such as that of a physical therapist in a clinic. Few persons can afford a CPM for use in the home. Further, CPMs are not portable.

SUMMARY OF THE INVENTION

The novel shoulder stretching and rotation machine of this invention provides for physical therapy of the shoulder joint through the passive internal and external rotation of the shoulder by utilizing a forearm support that may be maneuvered by a person in a supine position. The forearm support is movably attached to a horizontal support member having a vertical support member fixedly attached to one end. Mounted on the vertical support member are two eyelets or pulleys, one near the bottom and one near the top of the vertical support, for receiving and supporting a rope or cord attached at one end to the top of one side of the forearm support. The other end of the rope is passed first through the bottom pulley and then to the top pulley and then to the supine person such that when the person pulls the rope, force is applied to the forearm support which then folds towards the vertical support in a 90° arc, having as its axis the moveable attachment point of the forearm support to the horizontal support member. The rope may be attached to the top of the forearm support by tying it to an eyelet or by any other means of attachment.

On the other side of the forearm support, opposite the vertical support member, another eyelet or means of a rope attachment is placed at a suitable location from about halfway up the forearm support to near the top. The end of the rope coming through the top pulley on the vertical support may be attached to this eyelet forming a continuous circuit from the forearm support, through the pulleys on the vertical support, and back to the forearm support on the opposite side. The supine person may then pull on the opposite end of the rope, using the free arm that is not attached to the forearm support, thus pulling the forearm support in a direction away from the vertical support member and in an arc having an axis where the forearm support is movably attached to the horizontal member. In this manner, the supine person may maneuver the forearm support 90° from vertical in either a left or fight direction depending on which end of the rope the supine person pulls, resulting in a range of motion of about 180°. When the forearm support moves the attached forearm in this manner, the shoulder becomes stretched and rotated both internally and externally whereby the supine person controls the degree of stretching and rotation, the duration in time of the stretch and rotation, the amount of force applied to the stretch and rotation and the amount of force applied to the stretch and rotation. The shoulder may be rotated in one direction and then the other as desired, and the cycle may be repeated. Either the left or right shoulder may be exercised depending on which direction the supine person faces.

Accordingly, it is a primary object of this invention to provide an easy to use, self-assistive shoulder stretching and rotation machine, for physical therapy of either shoulder after surgery or injury, in which the shoulder can be internally and externally rotated. It is a further object of this invention to provide a shoulder stretching and rotation machine that can be operated by a person without the assistance of a doctor or physical therapist. The self-assistive operation of the invention allows for passive stretching and rotation of the shoulder through a 180° arc where the person controls the speed and degree of the stretch and rotation of the shoulder, the duration of the stretch and rotation of the shoulder, and the force applied to the forearm in stretching and rotating the shoulder.

It is also an object of this invention to provide a shoulder stretching and rotation machine which assists a shoulder surgery patient in gaining shoulder rotation range of motion wherein the patient has control of how much rotation is tolerated.

A further object of this invention is to provide a shoulder stretching and rotation machine which maintains the patient in a correct anatomical supine position.

It is also an object of this invention to provide a shoulder stretching and rotation machine that can be used in conjunction with professional physical therapy, that is inexpensive and portable such that a patient may afford such a machine for use in the home and may further transport it from place to place.

It is also an object of this invention to provide a shoulder stretching and rotation machine which may be used for either shoulder by the patient simply lying in a supine position perpendicular to the horizontal support member facing in one of two directions, depending on which shoulder is to be exercised.

BRIEF DESCRIPTION OF THE DRAWINGS

The details of a typical, but limiting, embodiment of the present invention is described in connection with the accompanying drawings in which.

DETAILED DESCRIPTION OF THE INVENTION

The term "internal rotation of the shoulder" means rotation of the shoulder caused by rotating the humerus of the upper arm inwardly toward the body, with the forearm at a 90° angle with the upper arm and the upper arm being alongside and parallel to the body.

The term "external rotation of the shoulder" means rotation of the shoulder caused by rotating the head of the humerus of the upper arm in a direction opposite to the internal rotation, that is, outwardly and away from the body, with the forearm and upper arm in the same position as for the internal rotation.

Figure 1:
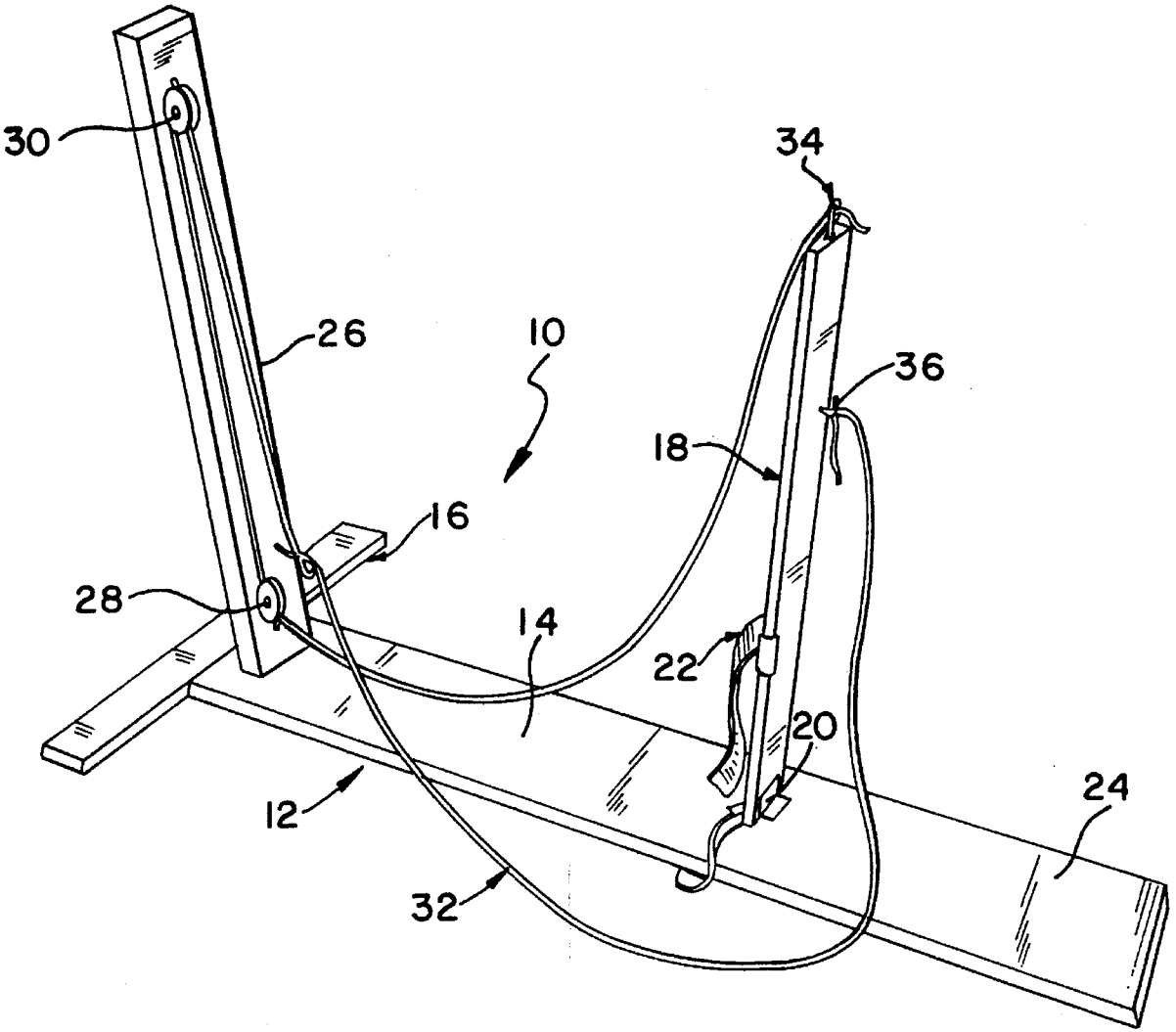
FIG. 1 is a side elevational view of the shoulder stretching and rotation machine.

Referring initially to FIG. 1 there is shown a plain view of a shoulder stretching and rotation machine 10 for therapeutic stretching and rotation of the shoulder. The shoulder stretching and rotation machine 10 has a solid horizontal support member 12. The horizontal support member 12 is made of a rigid material having a body length 14 having a length which exceeds the combined width of the average human upper body and the length of the average human forearm. The horizontal support member may also be padded or cushioned (not shown) to provide comfort to a supine person. A stabilizing support member 16 may be attached perpendicularly to one or both ends of the horizontal support 12 in a "T-shaped" fashion.

Figure 2:
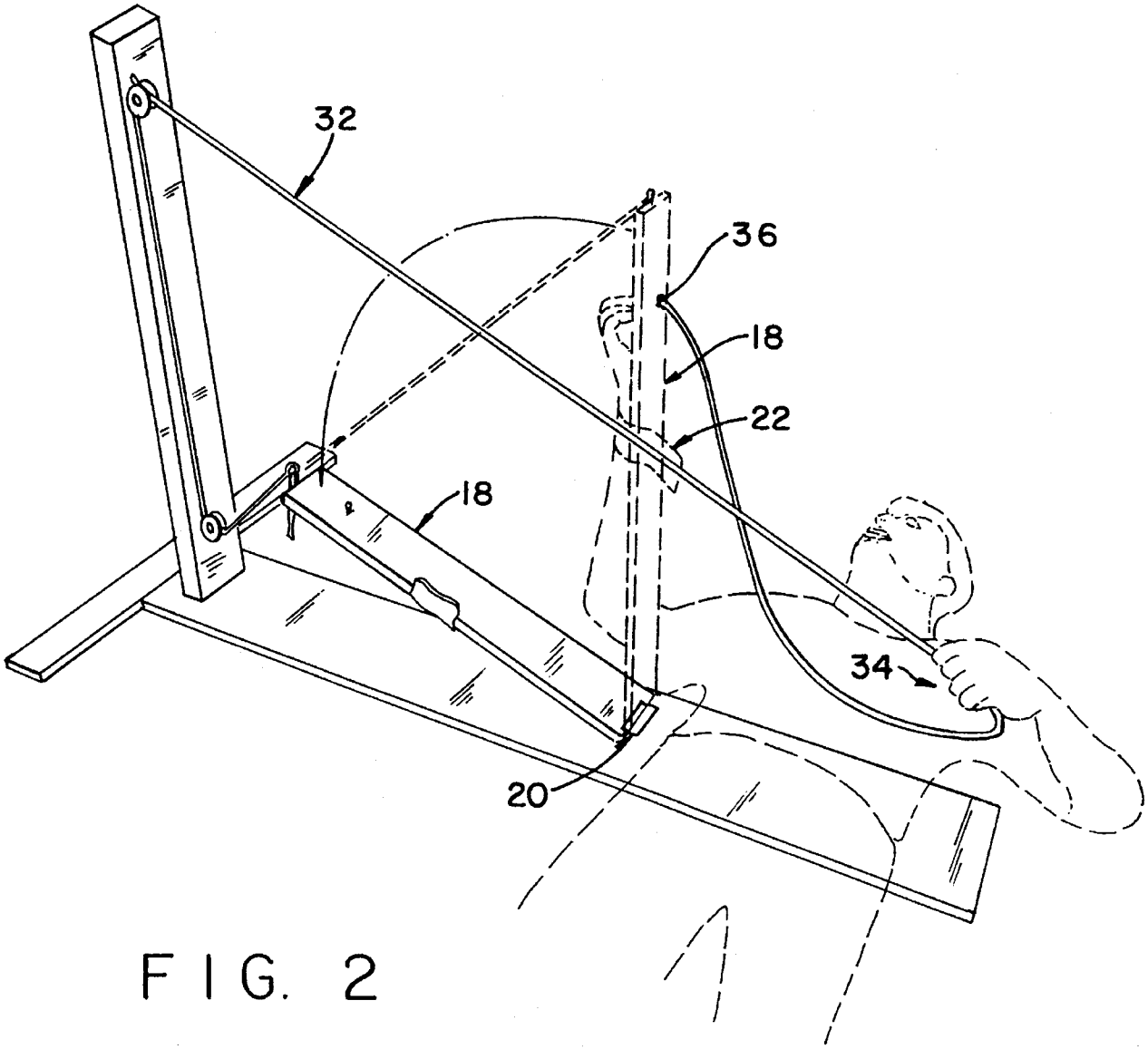
FIG. 2 is a side elevational view of the shoulder stretching and rotation machine being used by a patient in a supine position, specifically illustrating the manner in which the machine is used in a "right" direction (for stretching and rotation of the right shoulder)

A forearm support member 18 is vertically attached at about the mid-point of the body length 14 of the horizontal support member 12. The forearm support 18 is attached to the horizontal support member 12 by movable attachment means 20 which allows the forearm support 18 to fold or swing in a 90° arc from the vertical in either a left or right direction. The movable attachment means 20 could be a hinge or similar device which allows the forearm support 18 to move in the full range of movement described. It is preferred that the movable attachment means 20 only permit movement of the forearm support 18 in a left or right direction, insuring that the forearm is held in the desired 90° angle with the upper arm as shown in FIG. 2.

Attached to the forearm support 18 are means for securing the forearm 22 to the forearm support 18. Illustrated in FIG. 1 is a simple strap which would go around the forearm and become closed in the manner of a belt or, more simply by using Velcro®. The forearm support 18 can be made of any rigid material and should have a length exceeding the average length of a person's forearm. Cushioning material may be attached to the side of the forearm support 18 to which the forearm is to be secured to provide comfort (not shown).

At the end of the horizontal support member 12 near the stabilizing member 16, and being on the same side of the forearm support 18 where the forearm is secured, a vertical support member 26 is rigidly attached to the horizontal support member 12. On the vertical support member 26 are attached a lower pulley 28 and an upper pulley 30 used to support or guide a rope, cord or chain 32 which is used to supply force to the forearm support 18. The skilled artisan would recognize that any similar device may be used in place of the pulleys 28 and 30 such as an eyelet, which forms a loop through which the rope 32 may be passed.

The rope, or chain cord 32, or any similar flexible, strong material, is connected to the forearm support such that the person operating the machine may apply force to the forearm support 18 by pulling on the rope 32. One end of the rope 20 is attached through means of a eyelet 34 at the end of the forearm support 18 as shown in FIG. 1. The other end of the cord 32 is then placed first through the lower pulley 28 up to and through the upper pulley 30 and then attached to the opposite side of the forearm support 18 by an eyelet 36, or other attachment means, at about ⅓ the distance from the end of the forearm support 18. Thus, the rope or cord 32 forms a continuous loop in attachment with the forearm support 18. The rope or cord 32 should be of sufficient length to allow full movement of the forearm support 18 and, in addition, provide sufficient length for the operator to apply force to the forearm support 18 by pulling on the rope 32.

Referring next to FIG. 2 there is shown the manner in which the shoulder stretching and rotation machine may be operated by a person lying in a supine position. As shown, the right forearm of the person is attached to the forearm support 18 by means of the forearm securing strap 22. The operator is shown pulling on the rope 32 with his left hand and in a right to left direction shown by arrow 34. The result of the operator's applying force in this direction is to move the forearm support 18 to the right, providing, in this illustration, stretching and external rotation of the right shoulder. Accordingly, and as shown, in this manner the right shoulder may be stretched and externally rotated in an arc of 90° from vertical having as its axis the movable attachment point 20 of the forearm support 18.

In order to provide for internal stretching and rotation of the right shoulder, the operator may change the direction of the force applied to the forearm support 18 by pulling on the end of the rope 32 that is attached to the forearm support 18 at the eyelet 34. (See FIG. 1). One would observe that operator would also pull the rope in a fight to left direction (not shown). This would apply direct force to the forearm support 18 rotating it to the left and providing a range of internal rotation of 90°.

Referring also to FIG. 2, it can be clearly understood that the operator can control the amount of force applied for stretching and rotation of the shoulder by the amount of force or energy the operator exerts by pulling on the rope 32. Similarly, the operator may vary the length of the duration of the force applied and the degree of stretch or rotation. This may be done for both internal and external rotation.

Figure 3:
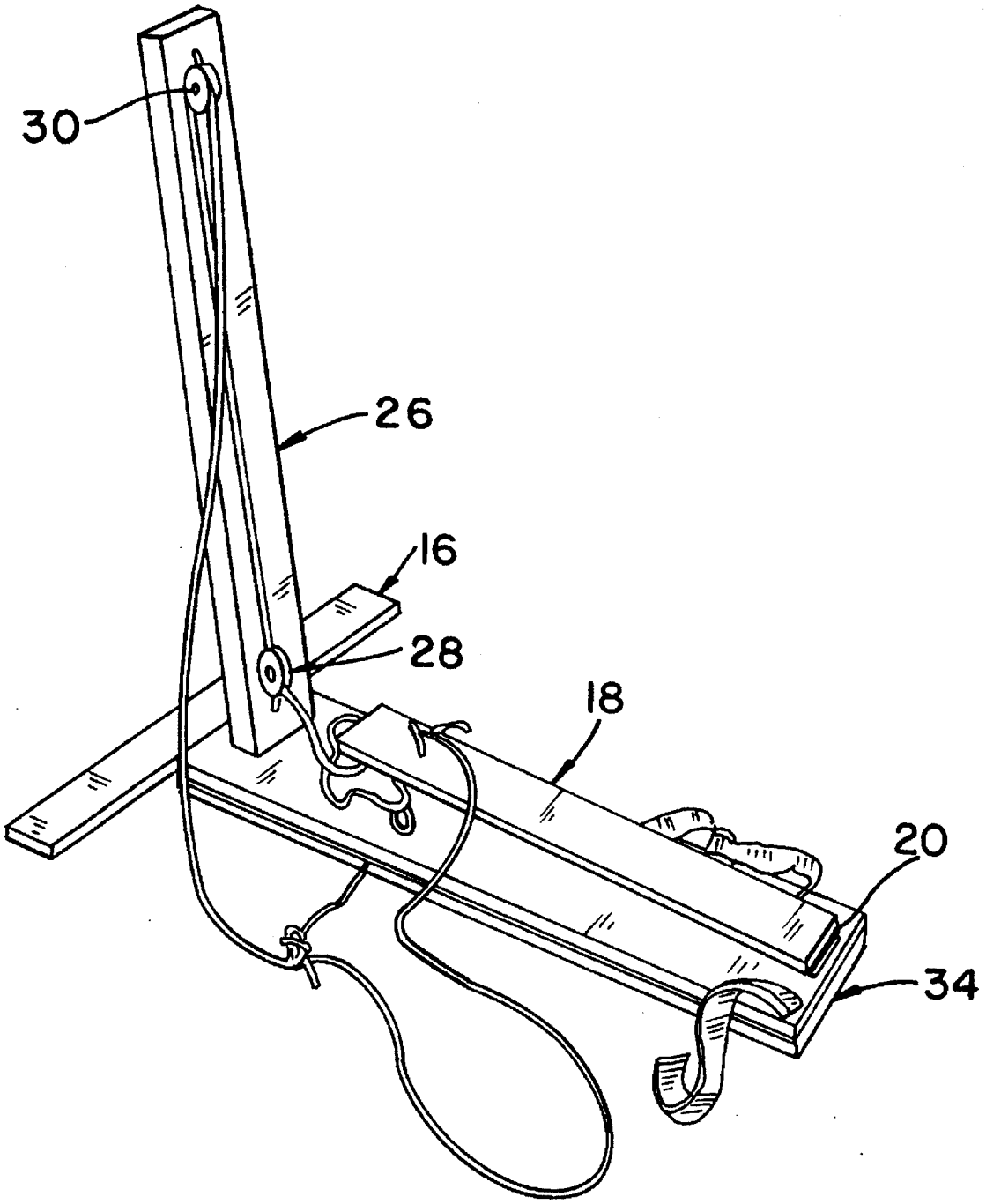
FIG. 3 is a side elevational view of the shoulder stretching and rotation machine shown in a folded position allowing for portability and transport.

FIG. 3 illustrates that a hinge may be added at about the center of the horizontal support member 12 to provide foldability and thus portability to the machine.

The present invention is not limited to the stretching and rotation of only one of the operator's shoulders but may be employed to stretch and rotate each of the operator's shoulders in succession. This may be done by simply reversing the supine position of the operator so that the left forearm of the operator becomes secured to the forearm support 18. In this manner, the operator would be supine, facing in the opposite direction. Also, appropriate modification of the size and location of some of the components of the present invention described above may be necessary when adapting the present invention for use by small children or very large individuals. While it is preferred that the operator be in a supine position, the invention may also be attached to a wall, for example, so that the operator may be in a standing position.

As will be apparent to those skilled in the art to which the invention is addressed, the present invention may be embodied in forms other than that specifically disclosed above without departing from the spirit or essence or central characteristics of a novel invention. Therefore, the articulated embodiment of the shoulder stretching and rotation machine described above is to be considered in all respects as being merely an illustration of a constructive embodiment of the invention tested as shown capable of carrying out the present invention. The scope of the present invention is as set forth in the appended claims, rather than being limited to the foregoing description.

What is claimed is:

1. A machine for the therapeutic stretching and rotation of the shoulder comprising:

a horizontal support member;

a forearm support movably attached at one end to the horizontal support for movement in a vertical plane and having forearm securing means for attaching the forearm to one side of the forearm support;

connecting means for allowing the user to apply force to the forearm support, said connecting means having two ends wherein one end is attached to one side of the forearm support and the other end is attached to the opposite side of the forearm support for self-assistively passively exerting shoulder stretching and rotation force to each side of the forearm support;

a vertical support fixedly attached to the horizontal support member and having means for supporting the connecting means;

whereby a person may cause self-assistive stretching and internal and external rotation of a shoulder, when the forearm of the shoulder is secured to the forearm support, by alternately applying force through the connecting means first to one side of the forearm support and then to the opposite side.

2. The stretching and rotation machine of claim 1 wherein the horizontal support member is made of a rigid, inflexible material.

3. The stretching and rotation machine of claim 2 further comprising cushioning means on the horizontal support member and the forearm support.

4. The stretching and rotation machine of claim 3 further comprising movable attachment means for the forearm support wherein the movable attachment means permits the forearm support to move only in a lateral direction in the plane of the horizontal support member.

5. The stretching and rotation machine of claim 4 wherein the connecting means comprises a rope, cord or chain.

6. The stretching and rotation machine of claim 5 further comprising stabilizing means attached to the horizontal support member.

7. The stretching and rotation machine of claim 6 further comprising a hinge in about the center of the horizontal support member whereby the horizontal support member may become folded lengthwise.

8. A self-assistive shoulder stretching and internal and external rotation machine comprising: a forearm support having a right side, a left side and means for securing a user's forearm to at least one of the right and left sides; connecting means for self-assistively exerting passive shoulder stretching and rotation force to each side of said forearm support wherein said connecting means has two ends, one end attached to the right side of a forearm support and the other end attached to the left side of said forearm support; and a horizontal support member, wherein said forearm support is movably attached at one end to said horizontal support member in a manner which allows the forearm support to move laterally in a 90 degree arc from the vertical in both a left and right direction, thereby allowing the forearm support to move in the left or right direction a total of substantially 180 degrees, as directed by the user and wherein the amount and direction of the force applied to the forearm support is commensurate with an input of mechanical energy by the user on the connecting means.

9. The self-assistive stretching and rotation machine of claim 8 further comprising a vertical support member attached to the horizontal support member and having means for supporting the connecting means.

10. The self-assistive stretching and rotation machine of claim 9 wherein the horizontal support member is made of a rigid, inflexible material.

11. The self-assistive stretching and rotation machine of claim 10 further comprising cushioning means on the horizontal support member and the forearm support.

12. The self-assistive stretching and rotation machine of claim 11 wherein the connecting means is selected from a group comprising a rope, a cord, and a chain.

13. The self-assistive stretching and rotation machine of claim 12 further comprising stabilizing means attached to the horizontal support member.

14. The self-assistive stretching and rotation machine of claim 13 further comprising a hinge in about the center of the horizontal support member whereby the horizontal support member may become folded lengthwise.

15. A method for therapeutic and rehabilitative exercise of the shoulder following traumatic shoulder injury, shoulder surgery or to aid in the recovery from shoulder disease by self-assistively stretching and rotating the shoulder through the use of a passive shoulder stretching and rotation machine comprising the steps of: securing the forearm of the shoulder to be exercised to a forearm support having forearm securing means and being rotably connected to a horizontal support member, exerting force to one side of the forearm support through a connecting means having two ends, one end of which is attached to one side of the forearm support, causing the forearm to move and either to internally or externally rotate the shoulder, exerting force to the opposite side of the forearm support through the connecting means, the second end of which is attached to the opposite side of the forearm support, causing the shoulder to rotate in a direction opposite from the previous internal or external rotation, and repeating the preceding steps until the desired amount of shoulder stretch and rotation has been achieved.

* * * * *